United States Patent [19]

Bradley

[11] Patent Number: 4,858,137

[45] Date of Patent: Aug. 15, 1989

[54] DETERMINATION OF THE STABILITY OF FLOATING STRUCTURES

[75] Inventor: Michael S. Bradley, Surrey, England

[73] Assignee: The British Petroleum Company p.l.c., London, England

[21] Appl. No.: 44,502

[22] PCT Filed: Aug. 29, 1986

[86] PCT No.: PCT/GB86/00511

§ 371 Date: Mar. 31, 1987

§ 102(e) Date: Mar. 31, 1987

[87] PCT Pub. No.: WO87/01349

PCT Pub. Date: Mar. 12, 1987

[30] Foreign Application Priority Data

Aug. 31, 1985 [GB] United Kingdom ..... 8521702

[51] Int. Cl.[4] ..... G08B 23/00; G01M 1/12

[52] U.S. Cl. ..... 364/463; 364/559; 73/65; 340/689

[58] Field of Search ..... 364/463, 550, 556, 559; 340/686, 689; 73/65

[56] References Cited

U.S. PATENT DOCUMENTS

| | | | |
|---|---|---|---|
| 2,865,566 | 12/1958 | Swenson | 235/61 |
| 3,329,808 | 7/1967 | Fisher | 235/193 |
| 3,917,937 | 11/1975 | Sten | 364/463 |
| 4,347,574 | 8/1982 | Parsons | 364/463 |
| 4,549,277 | 10/1985 | Brunson et al. | 364/559 |
| 4,647,928 | 3/1987 | Casey et al. | 364/463 |

FOREIGN PATENT DOCUMENTS

| | | |
|---|---|---|
| 2569157 | 2/1986 | France . |
| 86/02328 | 4/1986 | World Int. Prop. O. . |

*Primary Examiner*—Parshotam S. Lall
*Assistant Examiner*—Brian M. Mattson
*Attorney, Agent, or Firm*—Morgan & Finnegan

[57] ABSTRACT

The stability of floating structures is determined using a plurality of changes in weight distribution and by processing the resulting signals from two inclinometers arranged so as to measure the inclination about two orthongonal non-vertical axes. The inclinometer axes need not coincide with the structre axes as any divergence is compensated by the specified signal processing steps.

7 Claims, 6 Drawing Sheets

DETERMINATION OF THE STABILITY OF FLOATING STRUCTURES

The present invention relates to the determination of the stability of a floating structure, particularly when it is in service.

The stability of any floating structure such as a ship or a semi-submersible oil drilling rig, i.e. its resistance to capsizing, is obviously an important factor in its safety. It is therefore the practice for countries in whose waters such structures operate to require the structures to comply with certain regulations on stability.

In general, the stability of a floating structure is characterized by its stability arm. This is the difference in vertical height existing between the vertical center of gravity of the structure and its metacentric height as determined from simple hydrostatics. The Metacenter is that point on the structure's axis through which for small angles of inclination the line of action of the floating structure's buoyancy force normal to the water surface will act. This can be seen more clearly from FIGS. 1 and 2 of the drawings, which are described in more detail below.

In practice, because of the effects of mooring cable tensions, riser tensions, etc., the position of the Metacenter (M) as predicted from the hydrostatics of the structure will change. A stiffening of the structure's resistance to inclination will augment the height of the Metacenter and vice versa. The modified position of the Metacenter may be called the Protocenter (P).

The stability arm (GM) of the floating structure is conventionally measured by inclining the structure through a change in its weight distribution. If the moment of this weight distribution change about the floating structure's center of flotation is m, then from Naval Architectural Theory for small angles of induced inclination theta, the stability arm (GM) is calculated by:

$$GM = \frac{m}{D\tan(theta)}$$

D=displacement of the structure at the time the inclination occurs.

Conventionally, the moment generated (m) and the resulting angle of inclination (theta) will be devised to act in the roll or least stiff rotational axis of the floating structure.

One method which may be used to determine structure stability is to compare the structure's vertical center of gravity (VCG) with standard precalculated curves of maximum VCG. In order to make this comparison, it is necessary to determine an estimated service VCG.

As part of the standard procedure for determining VCG, an inclination test is carried out. A known heeling moment is applied, e.g. by moving a weight to a given position across the deck of the structure, and the resulting inclination is measured.

However, the inclination of the structure at any instant is affected by the wind and wave motion to which it is subjected. The conventional stability test, therefore, involves moving the structure to sheltered water close to the shore so that the effects of wave and wind action can be minimized. This incurs a commercial/operational penalty and the basic stability of the structure can, therefore, only be determined at relatively long intervals. Changes made to the structure or to the equipment and stores carried can lead to a change in stability in the period between tests.

It would clearly be desirable if the inclination of the structure in response to a given load, and hence the stability of the structure to capsizing could be determined while the structure remains at sea performing its normal duties.

According to the present invention, the method of measuring the inclination of a floating structure resulting from a change in weight distribution of the structure comprises:

(a) making a plurality of changes in the weight distribution of the structure, the changes being distributed about the center of flotation, taking signals at intervals over a period of time from two inclinometers so as to measure the inclination of the structure along two orthogonal non-vertical axes, (b) feeding the signals to signal processing apparatus, which apparatus (i) determines from the signals a value of the change of inclinations along each of the two orthogonal non-vertical axes, (ii) calculates an average value of the maximum change of slope of the plane of inclination in the two orthogonal axes and an average value of the direction (in the horizontal plane) in relation to the inclinometer axes of the maximum change of slope of the floating structure, (iii) compares for each change of weight distribution the observed direction of the maximum slope of inclination of the floating structure as determined from the inclinometer signals with the direction expected from the known change in weight distribution based on assumed values for the ratio of rotational stiffness in the principal stiffness axes of the floating structure, (iv) recalculates for the total number of changes of weight distribution by an iterative process which varies the ratio of the stiffness of the floating structure until the predicted values of direction of maximum slope gives the closest match to the observed values, (v) calculates a mean bias between the axes system of the inclinometers and the axes system in which the change in floating structure weight distribution has been made, and (vi) recalculates the mean values of inclination along each of the axes of the inclinometers using the calculated bias to give mean values of inclinations along the axes of the floating structure.

The steps recited above are not necessarily carried out consecutively. Thus, the step of obtaining the closest match between the predicted and calculated values of the direction of maximum slope involves testing various assumed values for the mean bias between the axes systems and the mean bias finally calculated is the value which, together with the stiffness ratio gives the best match.

According to another aspect of the present invention (as shown in FIG. 5), there is provided a floating structure 6 which comprises (a) two inclinometers 1 located on the structure 6 at a fixed position for a set of measurements so as to measure the inclination of the structure relative to two orthogonal non-vertical axes, the inclinometers 1 being capable of generating signals representing the changes of inclinations measured by the meters, (b) means for making a plurality of changes in the weight distribution 4 of the structure about the center of flotation, and (c) a signal processing apparatus 2 connected to the inclinometers 1 so as to receive the signals produced by the inclinometers 1, the signal processing apparatus 2 being arranged so that it:

(i) determines from the signals a value of the change of inclinations along each of the two orthogonal non-vertical axes, (ii) calculates an average value of the maximum change of slope of the plane of inclination in the two orthogonal axes and an average value of the direction (in the horizontal plane) in relation to the inclinometer axes of the maximum change of slope of the floating structure, (iii) compares for each change of weight distribution the observed direction of the maximum slope of inclination of the floating structure with the direction expected from the known change in weight distribution based on assumed values for the ratio of rotational stiffness in the principal stiffness axes of the floating structure, (iv) recalculates for the total number of changes of weight distribution by an iterative process which varies the ratio of the stiffness of the floating structure until the predicted values of direction of maximum slope gives the closest match to the observed values, (v) calculates a mean bias between the axes system of the inclinometers and the axes system in which the change in floating structure weight distribution has been made, (vi) recalculates the mean values of inclination along the axes of the inclinometers using the calculated bias to give mean values of inclinations along the axes of the floating structure.

Referring to FIGS. 5 and 6, the inclinometers 1 used may be commercially available inclinometers, using, for example, a pendular weight mounted on torsion pivot springs. Where the inclinometers 1 give analog outputs, it will generally be convenient to convert the output to digital form for subsequent manipulation of the data.

The inclinometers 1 are preferably located on a common rigid bed-plate 2 which rests upon or is attached to a rigid surface in the floating structure 6.

It may be often sufficient to place an instrument housing containing two inclinometers 1 arranged at right angles on a table on a deck of the floating structure 6 provided the floating structure is not moving to such an extent that the instrument housing slides on the table, and the table slides on the deck.

The bed plate 10 may be provided with levelling screws 11 to enable it to be set in an approximately level position.

It is not necessary for the orthogonal axes along which the inclinations are measured to be along the structure or structure axis and at right angles to it as the method of determining the inclination compensates for any divergence between the axes. The method however does depend on taking measurements indicating both pitch and roll. Roll is generally much more significant than pitch in conventional floating structures (e.g. ships) with a high ratio of length to beam. However for semi-submersible drilling rigs and similar structures particularly those approximating to a symmetrical configuration, it is less easy to discern the pitch and roll axes and the compensation provided overcomes the difficulty of alignment. The horizontal dimensions of length and breadth are obtained from the circumscribing dimensions of a map in the still water plane of the intersections of the floating structures and component parts with the water surface.

If it is assumed that the weight distribution of the structure has been adjusted to produce an inclination, then if the long axis of the structure is represented by X and the short axis by Y, the instantaneous inclination along X is dependent on the inclination due to the displacement of the weight combined with the pitch response of the floating structure. Similarly, the instantaneous inclination along the Y axis is dependent on the inclination due to the displacement of the weight combined with the roll response of the floating structure.

It is a function of the analysis procedure to determine the mean change in structure inclination due to the change in weight distribution. This is performed by averaging or filtering the instantaneous outputs of the inclinometers.

This averaging or filtering of the inclinometer outputs is performed over a period of time until a stable estimate of the mean value can be achieved.

The determination of the mean change in vessel inclination along the floating structure X and Y axes may be determined by special apparatus designed for each function, but is most conveniently carried out using an appropriately programmed general purpose computer.

The invention will now be described with reference to the drawings in which.

Figure 4:
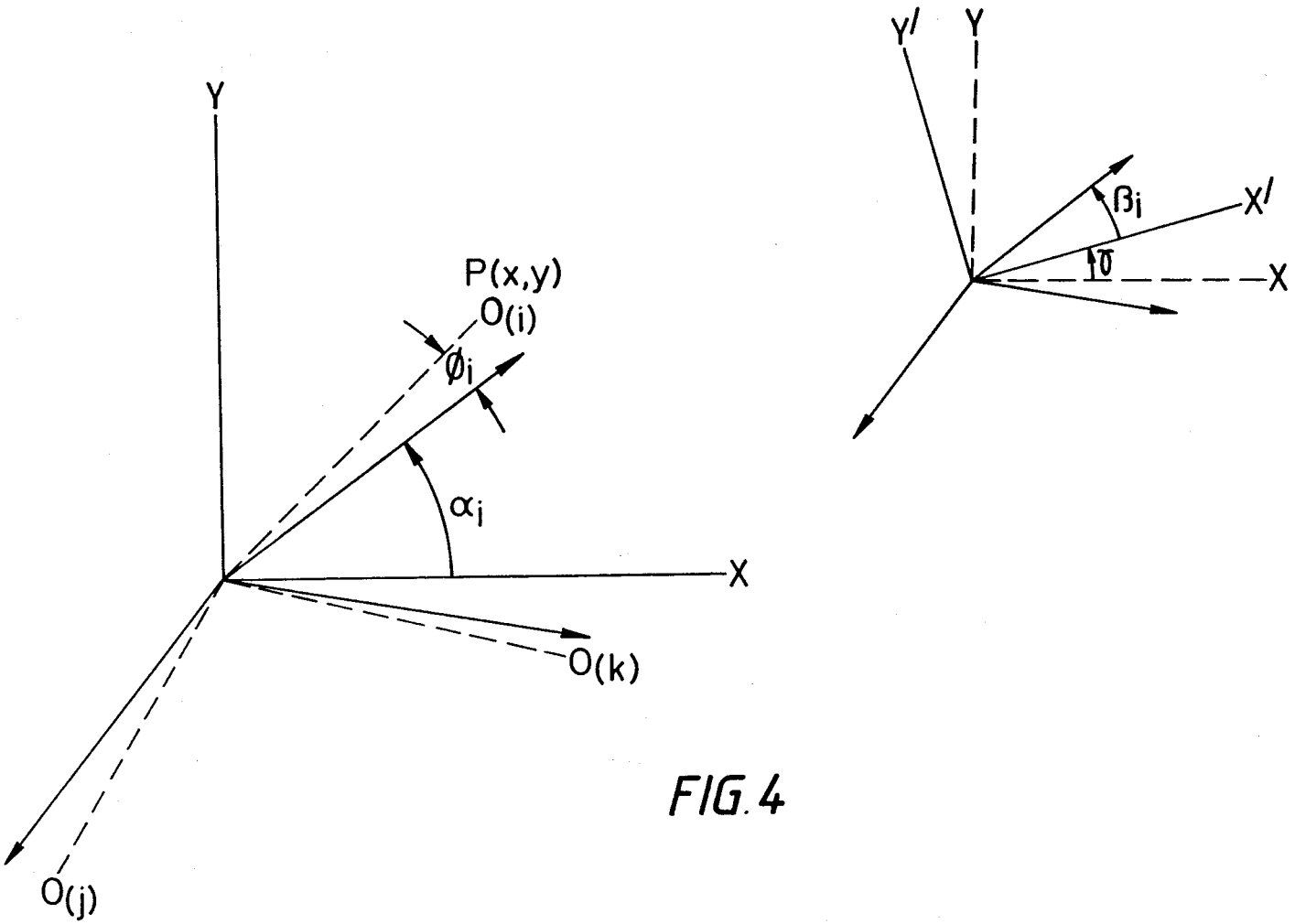
FIG. 4 is a representation of the position of an object at a point P(x,y) on a horizontal surface of the floating structure on the upper surface of the floating structure.

Also in FIG. 4 is a representation of angles relative to the two orthogonal axes along which the inclinometers measure inclination showing the directions of the inclinometer axes ($X^1$,$Y^1$) relative to the axes of the floating structure (X,Y). The position of the origin of the $X^1$, $Y^1$ axes in relation to the position of the origin of the X,Y axes is not known and does not need to be known.

Figure 5:
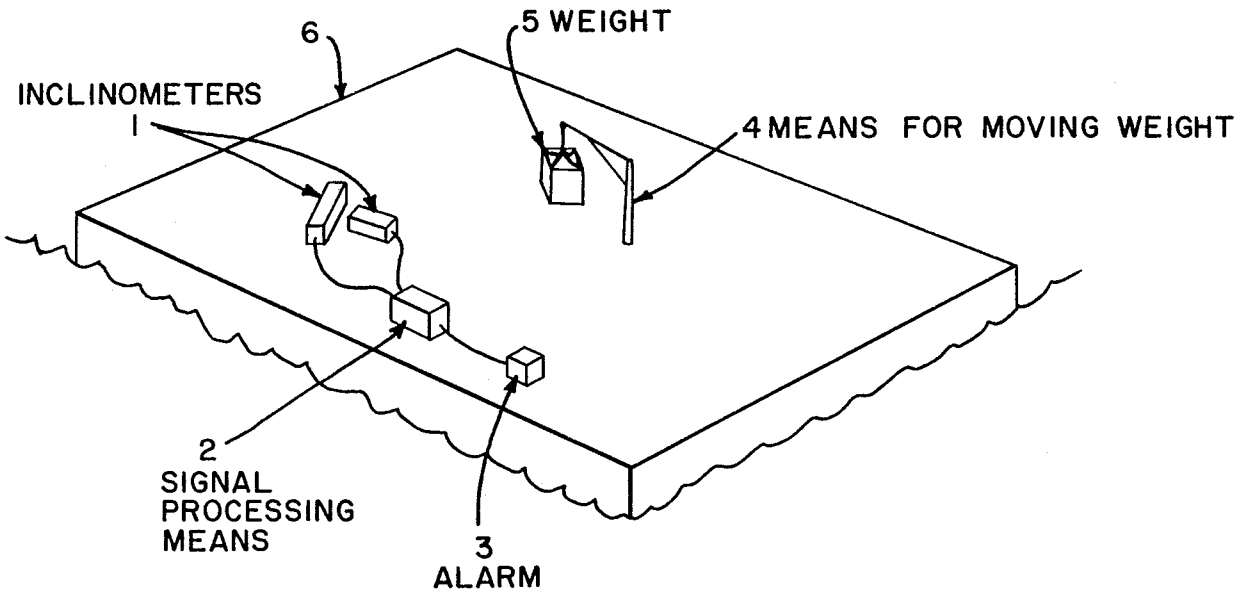

FIG. 5 is an illustration of a floating structure with an embodiment of the present invention attached thereto.

Figure 6:
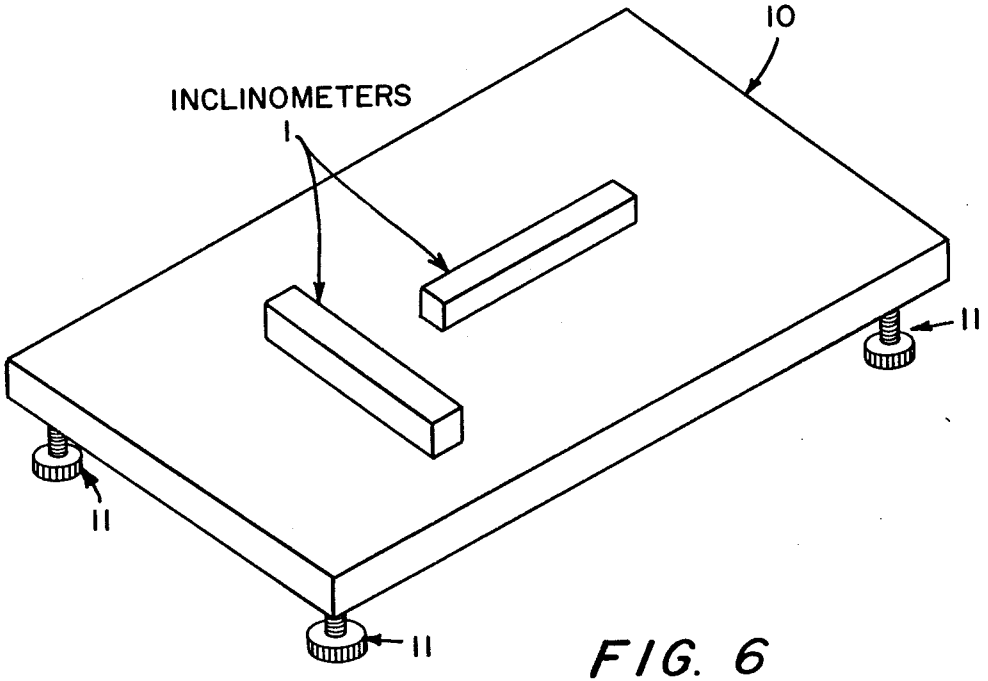

FIG. 6 is an illustration of the placement of the inclinometers used in a shown embodiment of the present invention.

Figure 1:
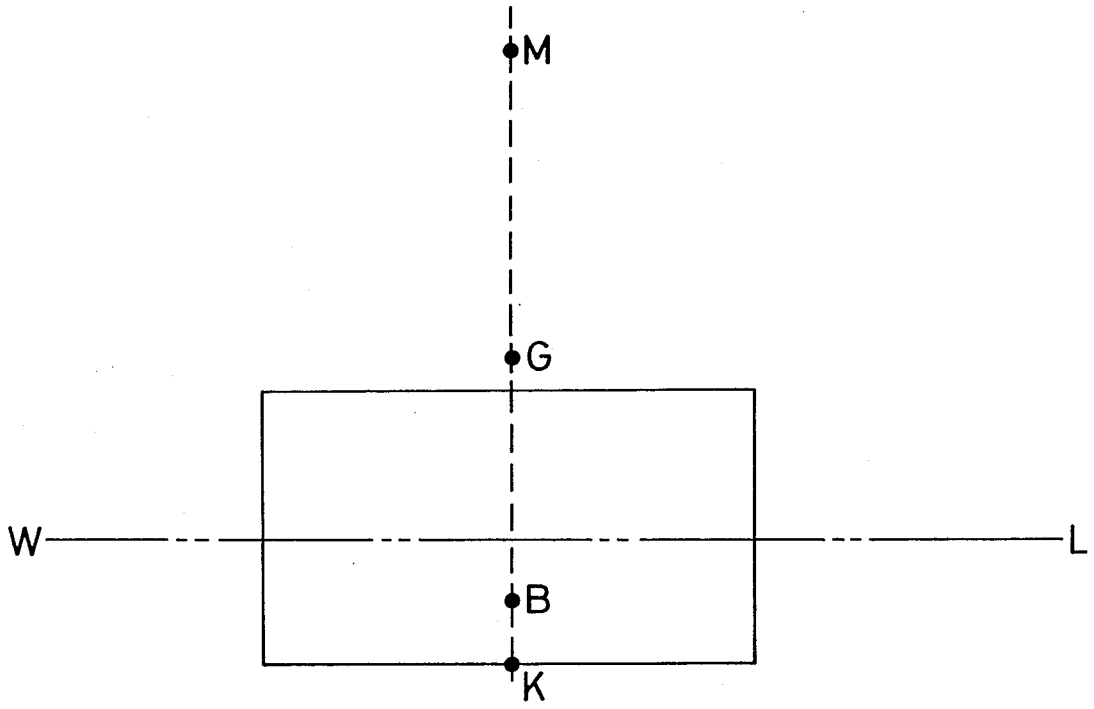
FIG. 1 is a diagrammatic representation of a cross-section of a floating structure, looking along its horizontal longitudinal axis, floating upright in still water.

In FIG. 1, the water level is indicated by the line marked WL. The position of the keel is indicated by K, the position of the center of buoyancy of the underwater volume is indicated by B, G indicates the center of gravity of the structure and M is the Metacenter.

Figure 2:
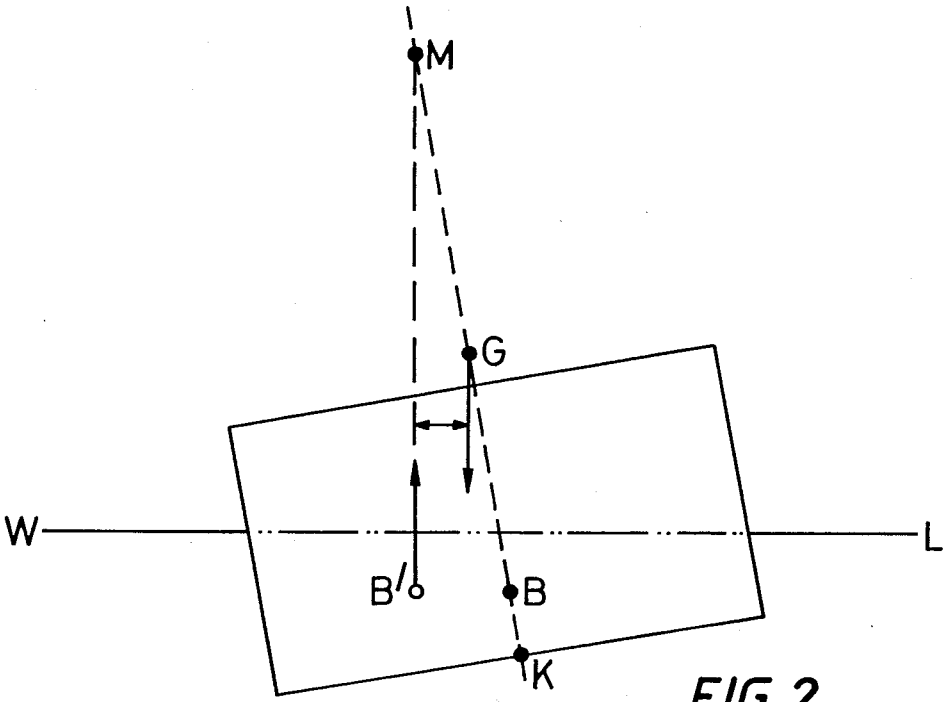
FIG. 2 is a diagrammatic representation of the structure of FIG. 1, inclined as a result of the application of an external force.

In FIG. 2, the part $B^1$ is the center of buoyancy when the structure is inclined. It will be seen that the longer the stability arm (the distance between the center of gravity G and the Metacenter M), the greater will be the turning moment generated by the buoyancy of the structure tending to return the structure to the level floating position.

Figure 3:
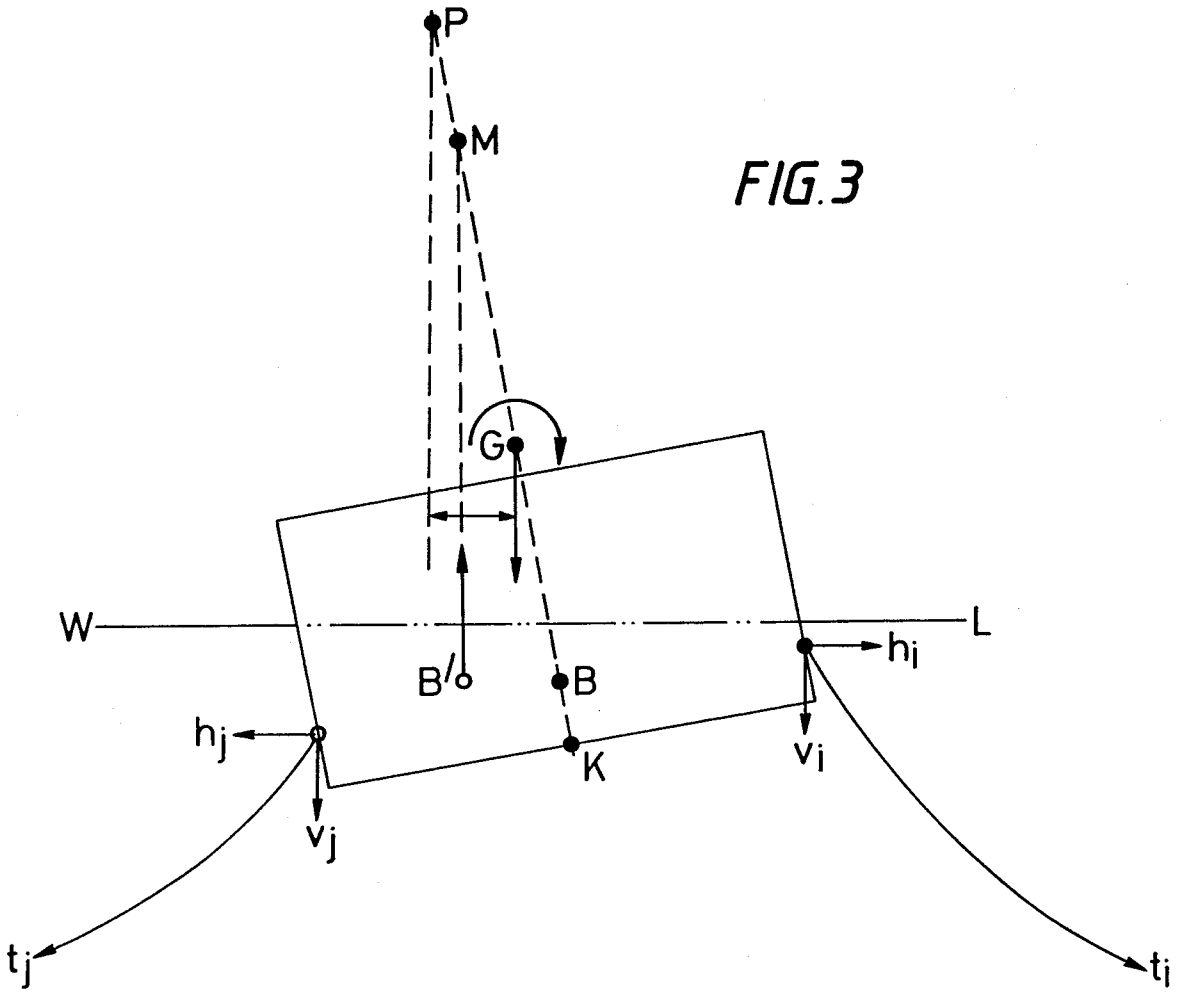
FIG. 3 is a diagrammatic representation of the inclined structure of FIG. 1, modified to show the effect of the attachment of mooring lines.

In FIG. 3, mooring lines identified as having tensions ti and tj are shown attached to the floating structure at some level above the keel (shown). The forces generated by these mooring lines may be resolved into horizontal and vertical components hi, vi, hj, vj. The effect of these horizontal components is to impart an additional restoring moment which adds to that produced by the displacement of the center of buoyancy to $B^1$. The direction of the turning moment is indicated by the curved arrow. As a result of the additional restoring moment, the apparent stability arm is given by GP (the distance between the center of gravity and the Protocenter.

In the present case, measuring of the stability arms of the structure in both the longitudinal axis and the transverse axis relative to the Protocenter (P) is performed. The Protocenter corresponds to the Metacenter (M) as modified by the effects of mooring cable tensions, riser tensions, etc., i.e. forces additional to those acting on a freely floating structure. If in fact the method is applied to a freely floating structure, the Protocenter will be the same as the Metacenter. The apparent stability arms can conveniently be referred to as $GP_t$: for the transverse direction $GP_1$: for the longitudinal direction.

As shown in FIG. 5, one method of carrying out the invention is to use a crane 4 mounted on the structure 6 to move a weight 5 to a position on the structure 6 and to determine the position at which the weight 5 acts in relation to two orthogonal axes of the structure 6. (An alternative method would be to alter the contents of a ballast tank in a known way). These correspond to the longitudinal and transverse axes and will be termed Y and X axes. Of course, if the structure 6 is symmetrical about a vertical axis then the choice of X and Y axes will be arbitrary. The weight is allowed to remain in position for a time which is long relative to the natural periods of roll and pitch of the structure 6 under the prevailing conditions so as to allow the effects of wave motion to be cancelled out by taking an average of or filtering the readings from the inclinometers 1. The time will depend on the structure 6 and the prevailing weather conditions. For an oil drilling rig, the time might be from 1 to 10 minutes, typically 4 to 8 minutes.

The weight 5 is moved to a plurality of different positions in turn where the above process is repeated. These positions need not be symmetrical about the origin of the X and Y axes. It is desirable for the positions to lie within at least three of the quadrants of the X-Y coordinate system. The positions of the weight 5 in the X-Y coordinate system are fed to the signal processing apparatus 2 in addition to the signals produced by the inclinometers 1. The positions may be determined by suitable sensors or may be entered into the signal processing apparatus 2 by a human operator.

The situation at the i th change in position of the weight (e.g. the i th ballast position) is shown in FIG. 4. The ballast weight acts at point P(x,y), where x and y are distances measured along the vessel X and Y axes.

The origin of the X,Y axes, which will preferably be at or near the center of flotation of the floating structure, and the position on the structure at which the weight is placed will define a vertical plane which may be termed the P plane. A structure reference plane may be defined in relation to points on the structure by a horizontal plane passing through the X,Y origin when the structure is in still water and no weight is placed at point P. This may correspond to a deck on the structure. Placing a weight at point P will cause the structure reference plane to tilt away from the horizontal. There will be a vertical plane passing through the X-Y origin such that the line formed by the intersection of the vertical plane with the reference plane has a maximum slope. The angle in a horizontal plane between this vertical plane and a vertical plane through the X-axis is alpha(i). FIG. 4 represents a situation in which the stiffness of the structure in the Y-axis is greater than the stiffness in the X-axis. The vertical plane corresponding to maximum slope does not, therefore, pass through P(x,y) but is rotated towards the X-axis. The angle between the X-axis vertical plane and the P vertical plane is theta(i) which equals alpha(i)+phi(i). Phi(i) is related to the XY stiffness ratio; theta(i) is measured at the time the weight displacement is made. However, the angle of the vertical plane of maximum slope is initially determined by the signal processing apparatus in relation to the inclinometer axes. Beta(i) is the angle corresponding to alpha(i), but measured relative to the inclinometer X axis. If gamma is the angle between the inclinometer X-axis and the structure X-axis then alpha(i)=beta(i)+gamma. Gamma is initially unknown and thus so is alpha(i).

Further weight transfers are made for example the j th and the k th. Alpha(j) will be different from the measured theta(j) because the stiffness about the X- and Y-axes are different. Theta(k) is also in general different from alpha(k) measuring anti-clockwise from the X-axis. When a plurality of measurements have been made, then values of the stiffness ratio and of gamma may be assumed, and the value of alpha may then be calculated from the known theta and the assumed ratio. Alpha may also be calculated from the known value of beta and the assumed value of gamma. The two values of alpha will only agree for all the positions of the weight if the assumptions are correct. The signal processing apparatus may be fed with a value of the stiffness ratio which is believed to be approximately correct for the structure being tested, or an arbitrary value may be stored initially in the signal processing apparatus. The signal processing apparatus takes the assumed value of the stiffness ratio and uses an iterative procedure in which the stiffness ratio is recalculated and used to calculate predicted values of the direction of maximum slope which are then compared with values of the direction of maximum slope based on varying the mean bias (corresponding to the angle gamma) until the best match is obtained.

Once the signal processing apparatus has determined gamma, it can recalculate the inclination along the structure's X- and Y-axes for any or all of the weight displacements. As X and Y inclinations are then known for each weight displacement the stability arms for the two axes can be readily calculated. The signal processing apparatus may, if desired, finish its task by generating a signal representing the inclination for any given weight displacement which may be displaced or recorded for subsequent analysis. It will generally be preferred to use the signal processing apparatus to carry out further processing on the inclination so as to calculate stability arms for the X- and Y-axes. The resulting values may be displayed or may be used to activate an alarm system. Thus a weight may be moved to defined positions on a structure automatically and the signal processing apparatus may be connected to an alarm which is triggered if the stability for a given axis falls below a preset value.

An alternative approach to describing the operation of the invention is set out below. Suppose that a change in weight distribution of the floating structure is deemed to occur at a point P(x,y) in the floating structure X and Y coordinate system, then we have relative to the structure Y-axis that the vector direction connecting the change in weight distribution to the center of flotation is theta($_d$), where theta($_d$)=$\tan^{-1}(x/y)$.

Generally, the angle theta($_{di}$) in this axis system that the structure will exhibit maximum slope of inclination will differ from theta($_d$) owing to the differing stiffnesses against inclination in the X- and Y-axes. For example, suppose that the structure were infinitely stiff in the Y direction, then no inclinations would occur in this direction and the structure would incline only in the X direction. Theta($_{di}$) would then take the values ±90 degrees depending on whether the (x) position of the weight distribution change is positive or negative. Similar arguments are valid for a structure infinitely stiff in the X direction. Should the structure have equal stiffness in both the X and Y directions, then the angle theta($_d$) defined above will also represent the direction of maximum inclination, theta($_{di}$) occurring because of the change in weight distribution. Known algebraic equations can be derived which will show the modifications occurring in the rotation angle of maximum inclination slope (theta($_{di}$)) depending on the ratio of the stiffness of the floating structure against inclinations in its X- and Y-axes.

Measurements of the roll and pitch angles of the floating structure are derived from the inclinometer outputs and using those values the net changes in structure attitude can be determined which result from a known change in weight distribution.

Typically the results available from the inclinometers after a single weight distribution change would be the maximum slope of the inclined plane which the structure has adopted and the direction which this plane makes to the instrument axes system.

For one such measurement, the comparison between the expected direction of maximum slope and the observed direction of maximum slope as derived from the inclinometer outputs is trivial—they must coincide and no judgements can be made regarding the ratio of floating structure stiffness against inclination in the X and Y directions.

Suppose instead that several such weight distribution changes and associated observations are made over a comparatively short period of time (say 2–3 hours), then on average, all the observations must fit all of the predictions.

If the positions of the changes in weight distribution are distributed in approximately equal divisions throughout their possible range of headings relative to the center of flotation of the floating structure (0 to 360 degrees), then it is possible to adjust two quantities to enable a better fit to be achieved between the observed headings of maximum inclination and the measured angles of maximum inclination.

Quantity A: The mean difference in angle between the observed and expected headings of maximum inclination.

Quantity B: The ratio between the floating structure stiffnesses in the X and Y direction so as to vary the expected heading of the maximum inclination angle.

After a series of weight distribution changes on the floating structure and associated measurements the Quantities A and B are solved in a mathematically iterative manner until the error between expectation and observation is minimized.

This orientates the instrumentation relative to the floating structure and defines the ratio between the different stiffnesses against inclination in the axes system of the floating structure. Once these are known, then the stability arms of the floating structure ($GP_t$, $GP_1$) can be determined in the conventional manner by considering the proportion of the maximum inclination angle which occurs in each axis direction along with the moment in that axis direction arising as a result of the weight distribution changes.

I claim:

1. A method of measuring inclination, of a floating structure having a center of flotation, resulting from a change in weight distribution which comprises:

(a) making a plurality of changes in weight distribution of a structure, said changes being distributed about said structure's center of flotation, generating signals at intervals over a period of time by two inclinometers so as to measure said structure's inclination along two orthogonal non-vertical axes, (b) feeding said signals to signal processing apparatus, which apparatus:

(i) determines from said signals a value of the change of inclinations along each of said two orthogonal non-vertical axes, (ii) calculates an average value of maximum change of slope of a plane of inclination in said two orthogonal axes and an average value of direction in a horizontal plane, in relation to axes of said inclinometers of said maximum change of slope of said floating structure, (iii) compares for each said change of weight distribution an observed direction of said maximum slope of inclination of said floating structure as determined from said inclinometer signals with a direction expected from a known change in weight distribution based on assumed values for ratio of rotational stiffness in said structure's principal stiffness axes, (iv) recalculates, for the total number of changes of weight distribution, by an iterative process which varies said ratio of said stiffnesses of said floating structure until the predicted values of direction of maximum slope gives a closest match to said observed values, (v) calculates a mean bias between said axes system of said inclinometers and said axes system in which the change in floating structure weight distribution has been made, (vi) recalculates mean values of inclination along said axes of the inclinometers using said calculated bias to give mean values of inclinations along said axes of said floating structure.

2. The method according to claim 1 wherein said inclinometers are located on a common rigid bed plate which rests upon or is attached to a rigid surface in said floating structure.

3. The method according to claim 2 wherein said bed plate is provided with leveling screws to enable said bed plate to be set in approximately level positions.

4. The method according to claims 1, 2 or 3 wherein said inclinometers generate an analog output which is converted to digital form before processing by said signal processing apparatus.

5. The method according to any of claims 1, 2, 3 or 4 wherein a stability arm in both the longitudinal and transverse direction is determined.

6. The method according to any one of claims 1, 2, 3, 4 or 5 wherein said stability arm in at least one of the transverse and longitudinal directions is compared against pre-set limits and an alarm is actuated if said limits are exceeded.

7. An apparatus for determining stability, of a floating structure having a center of floatation, which comprises:

(a) two inclinometers located on a floating structure at a fixed position for a set of measurements so as to measure inclination of said structure relative to two orthogonal non-vertical axes, said inclinometers being capable of generating signals representing inclinations measured, (b) means for making a plurality of changes in weight distribution of said structure about said structure's center of floatation, and (c) a signal processing apparatus connected to said inclinometers so as to receive said signals produced by said inclinometers, said signal processing apparatus being arranged so that it:

(i) determines from said signals an instantaneous value of inclinations along two orthogonal non-vertical axes, (ii) calculates an average value of maximum slope of a plane of inclination in said two orthogonal axes and an average value of direction in a horizontal plane, in relation to axes of said inclinometers, of maximum change of slope of the floating structure, (iii) compares for each change of weight distribution an observed direction of maximum slope of inclination of said floating structure with a direction expected from a known change in weight distribution based on assumed values for ratio of rotational stiffness in said structure's principal stiffness axes, (iv) recalculates, for the total number of changes of weight distribution, by an iterative process which varies said ratio of said stiffness of said floating structure until predicted values of direction of maximum slope gives a closest match to said observed values, (v) calculates a mean bias between said axes system of said inclinometers and said axes system in which said change in floating structure weight distribution has been made, (vi) recalculates mean values of inclination along said axes of said inclinometers using said calculated bias to give mean values of inclinations along said axes of the floating structure.

* * * * *